United States Patent [19]

Lexnas

[11] 4,073,033

[45] Feb. 14, 1978

[54] DOOR CLOSING DEVICE

[75] Inventor: Sven-Olof Lexnäs, Vastra Frolunda, Sweden

[73] Assignee: Stilexo Johansson & Co. Aktiebolag, Skillingaryd, Sweden

[21] Appl. No.: 658,126

[22] Filed: Feb. 13, 1976

[30] Foreign Application Priority Data

Feb. 14, 1975 Sweden ..... 7501659

[51] Int. Cl.[2] ..... E05F 3/10

[52] U.S. Cl. ..... 16/52; 16/DIG. 9

[58] Field of Search ..... 16/51, 52, DIG. 9; 188/313, 318

[56] References Cited

U.S. PATENT DOCUMENTS

| | | | |
|---|---|---|---|
| 2,586,135 | 2/1952 | Woodruff | 16/51 |
| 2,829,395 | 4/1958 | Schlage | 16/52 |
| 2,834,039 | 5/1958 | Sasse | 188/318 X |
| 2,964,779 | 12/1960 | Gohr | 188/318 X |
| 3,887,961 | 6/1975 | Saajos | 16/51 X |

*Primary Examiner*—Werner H. Schroeder
*Assistant Examiner*—Conrad L. Berman

[57] ABSTRACT

A door closing device of the type having a piston and cylinder is described, the piston being movable within the cylinder under the bias of a spring and being connected to an arm mechanism which is arranged to transmit movement of the piston into pivoting movement of a door and vice versa, the device including a number of by-pass channels arranged to bring portions of chambers separated by the piston into communication with one another, whereby to limit the speed of flow of a dampening medium contained in the cylinder and passing through the channels as the piston is reciprocated.

3 Claims, 5 Drawing Figures

DOOR CLOSING DEVICE

Figure 1:
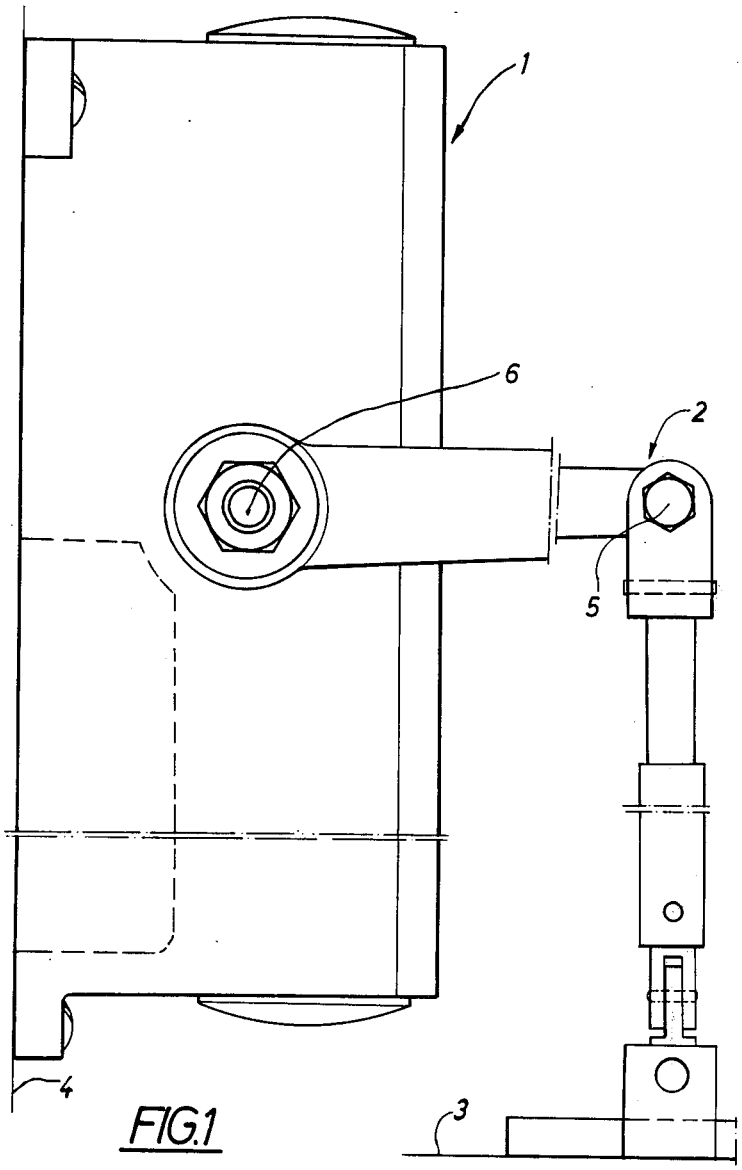

In door closing devices, it is common practice to provide auxiliary means to retain in an open position for a longer time than normally required for the passage of a person through the same. In such cases the usual solution involves providing the door with a locking device which disengages the normal closing function of the door closing device, which however, is generally manually operated by the person passing through the door who in many cases has no free hand for this operation.

It is an object of the present invention by reliable means to make it possible to maintain a door open for a period of time, which can be varied according to the actual need.

Said object is obtained with a door closing device according to the present invention which is characterized by a piston and cylinder having a dampening medium and at least one by-pass channel in the wall of the cylinder communicating spaces separated by the piston at a position, which is passed by a sealing portion of the piston during its displacement, so that the flow through said channel will be controlled by the movement of the piston unit.

By arranging a by-pass channel, which brings the chambers located at each side of the piston unit forming part of the door closing device in communication with one another along only a part of the total distance of displacement of the piston unit, a higher speed of the closing movement is obtained, which varies between preferably two separated angular intervals, so that the door at the beginning of the closing operation moves very slowly and thereafter performs a more rapid movement.

According to an especially advantageous embodiment of the present invention a particularly good sealing effect is obtained between the piston unit and the cylinder space. Thus effect can be maintained also in mass production with close tolerances and at modest cost. A spring is also provided exercising its bias force upon one side of the piston which force can hereby be given such a dimension that a greater closing force can be obtained than what has earlier been possible in connection with door closers of normal size. This means that according to the invention one and the same size of door closer can be used for several different sizes of doors. The advantages obtained by such an arrangement in connection with the manufacturing, the storage, the sale and service with spare parts of door closers should be evident to everyone. In connection with door-closers of conventional design a great difficulty has been the attainment of a sufficient closing force at the very moment of closing, when the spring force is at a minimum and at the same time the resistance of the locking mechanism must be overcome. This difficulty manifests itself especially in connection with automatic and remotely controlled doors, as then the risk is involved that the automatic locking mechanism will not locate the correct position. Practical tests made with the door-closer devices according to the invention have proved that the required force for the closing operation is obtained in all angular positions of the door.

Figures 2, 5:
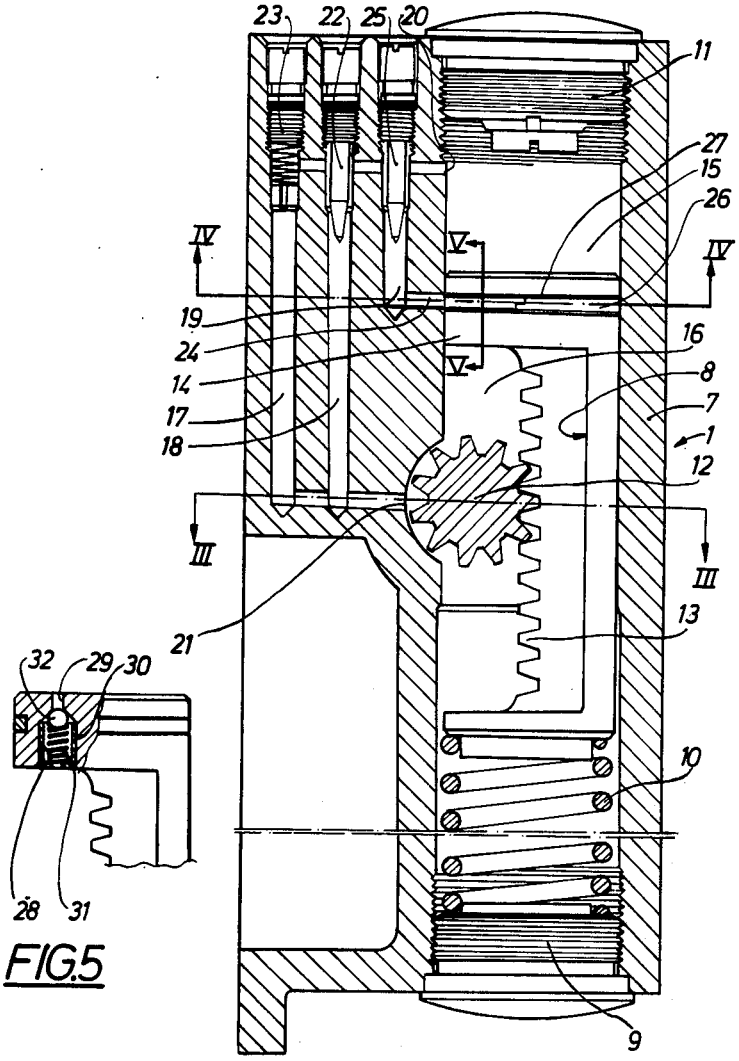

The invention will now be described more in detail in the following description of an example of a preferred embodiment, reference being made to the accompanying drawings, in which FIG. 1 is a top plan view of a door-closing device according to the invention, FIG. 2 is a partly broken cross sectional view of the same, taken along a plane parallel to FIG. 1, the location of which is shown on line II—II of FIG. 3.

Figure 3:
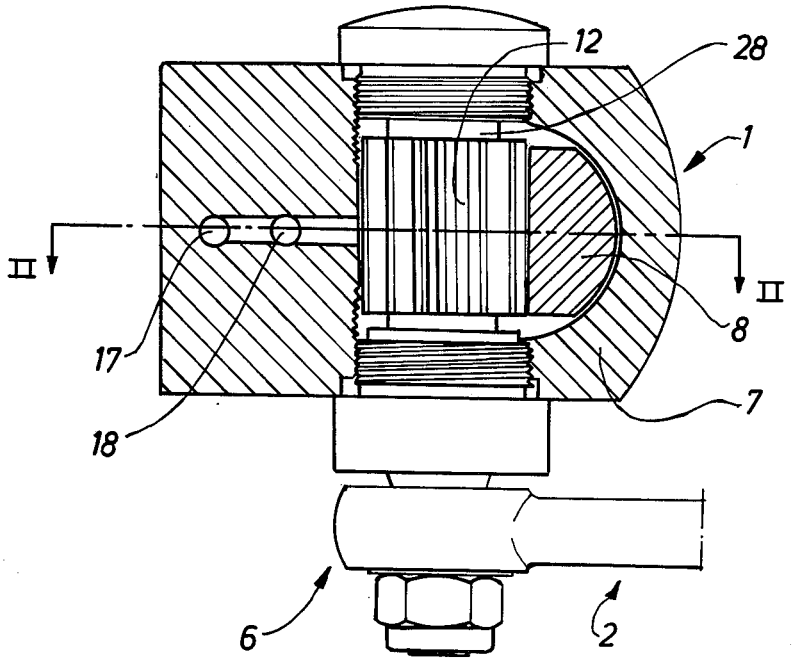
Figure 4:
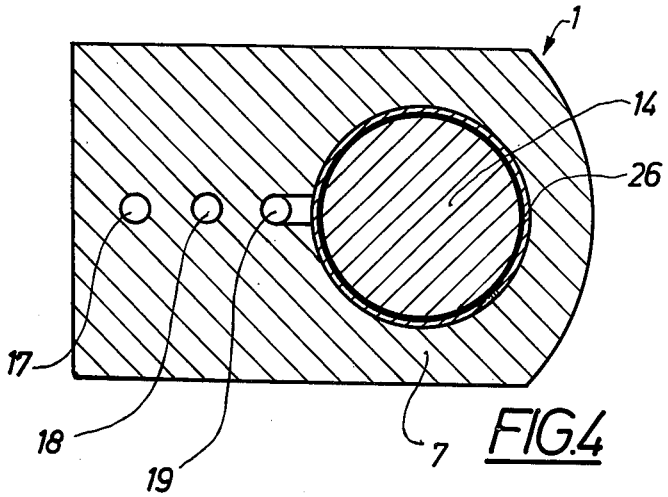

FIG. 3 is a view of a cross section through the door closing device along the line III — III in FIG. 2, and FIG. 4 is a view of a cross section along the line IV — IV in FIG. 2 and FIG. 5 is a broken sectional view along V—V of FIG. 2 of part of a piston unit included into the device, said part being broken along a radial plane of said piston unit.

From FIG. 1 it is evident that the door closing device according to the invention in the example of the embodiment illustrated comprises a principal unit 1 and an arm mechanism 2, one of its ends being pivotably connected with the main unit and its other end pivotably connected with a door panel 3, the main unit being fastened to the door case 4 or vice versa. As in the example shown the arm mechanism 2 can by way of example comprise a conventional two part arm with an intermediate link 5, the pivoting movements of the door panel 3 being transmitted to a pivoting of the arm mechanism 2 round its link point 6 in the principal unit 1 and conversely.

As is evident from FIG. 2 the main unit 1 substantially comprises a cylindrical unit 7, in which a piston unit 8 is reciprocably movable in a cylinder bore in a manner which will be described more in detail below. Between the piston unit 8 and one end portion 9 of the cylinder 7 a pressure spring 10 is inserted, which thus tends to move the cylinder unit 8 towards the opposite end portion 11 of the cylinder 7. The arm mechanism 2 illustrated in FIG. 1 extends into the cylinder unit 7 at its link point 6 with a pivot 28 (FIG. 3) on which a gear 12, is mounted which can be driven by the arm mechanism 2 and which is in mesh with teeth of rack 13 arranged in the piston unit 8.

In order to obtain a controllable damping of the movement of the piston unit 8 in the cylinder unit 7, the latter is filled with a dampening medium, by way of example oil, in the two chambers 15, 16 of the cylinder space located on each side of a sealing portion 14 of the piston unit intended for sealing chamber 15 and 16 from one another. These chambers 15, 16 are in communication with each other by means of at least one of four by-pass channels 17, 18, 19. Three of the by-pass channels 17, 18, 19 are formed by cavities in the cylinder unit 7 and each communicating at one end with a common orifice 20 which in turn communicates with the one end of the cylinder space 15, which is located farthest away from the spring 10. Two of said by-pass channels 17, 18 communicate at their other ends with a common orifice 21 which in turn communicates with the space 16 of the cylinder space located at the opposite side of the sealing portion 14 of the piston unit 8. The orifices 20, 21 are located outside of the range of movement of the sealing portion 14 of the piston unit 8. A check or throttle valve 22 is arranged in channel 18; and a non return check valve 23 is arranged in channel 17 to block any flow in this channel in a direction from chamber 15 of the cylinder space to chamber 16, while permitting flow in the opposite direction with a minimum of resistance.

Moreover the third by-pass channel 19, which at one end of its ends communicates together with the two channels 17, 18 with chamber 15 through the orifice 20, at its other end communicates with an orifice 24, which is located between the orifices 20 and 21 and within the path of movement of the sealing portion 14 of the piston unit 8. In this by-pass channel 19 a check or throttle valve 25 is inserted, which like the check or throttle valve 22 in the by-pass channel 18 has an adjustable throttling action, whereby a desired speed of closure of the door can be set for the different angular intervals. In the embodiment shown said adjustment is arranged by turning the check valves 22, 25, which are threaded in the cylinder unit 7.

As is evident from FIGS. 2 and 4, and as has been mentioned previously, the sealing portion 14 of the piston unit 8 passes over the orifice 24 connecting with channel 19. This makes it unsuitable to arrange any gasket of a soft typ, by way of example an O-ring of rubber, on the piston unit, because such a gasket would soon be worn down by the passings over the edges of the orifice. One solution is to provide the necessary seal by a very close fit between the piston and the cylinder. However, this can not prevent a certain by-pass flow past the piston, and moreover, it is an expensive construction. However, according to the invention one has solved the problems mentioned with respect to sealing and wear by providing the piston with a sealing ring 26 of the type illustrated in FIGS. 2 and 4. It is preferably of the expansion type and is inserted in a groove in the piston unit 8, the material being metal, by way of example a steel alloy or cast iron. The expansion can be arranged by the ring being provided with an opening, it being machined at its periphery in clamped condition.

Referring to FIG. 5, a fourth by-pass channel 29 is positioned in the sealing portion 14 of the piston unit 8. In said channel 29 a non return check valve is located, which according to the embodiment shown, is enclosed in a casing 30, providing valve chamber 28 with a seat and a biasing spring 31, which tends to bias a ball 32 with a tight fit against the seat. This non-return valve is so arranged that it opens when the pressure of the dampening medium in the space portion 15 exceeds the pressure in the space portion 16 on the other side of the sealing portion 14 by a predetermined valve.

Practical tests have shown that the improved sealing action, which is provided with the sealing ring of the present invention yields much better operating conditions than what is possible with equipment of conventional design with a machined piston without any gasket, so that one and the same door-closer can be used for a greater range of purposes. This means that the range of applications of the closer of this invention can be covered with a smaller number of different sizes of door-closers than is possible with door-closers of conventional design.

When a door is closed, the piston unit 8 occupies a position at one of the extreme ends of its travelling path in the cylinder space 7. Then, the channels 17, 18, 19 communicate with their common orifice 20 in the portion 15 of the cylinder space. The other end of the channels 17, 18 communicate with the orifices 21 and 24 respectively at the other side of the sealing portion 14 of the piston unit 8 in the chamber 16. When the door is opened, i.e. pivoting of the door panel 3 outwards is taking place, this movement via the arm mechanism 2 is transmitted to a pivoting movement of the gear 12 in counter-clockwise direction (see FIG. 1), whereby the piston unit 8 is displaced in the cylinder 7 against bias of the pressure spring 10 to a position, which is determined by the angle of opening, to which the door panel has been opened. During this opening movement the dampening medium on account of the pressure differences existing on each side of the sealing portion 14 of the piston unit by its motion flows over from the portion 16 to the portion 15 of the cylinder space, this taking place substantially through the by-pass channel 17, the non return valve 23 of which then is open caused by the pressure decrease present over the same end and in this position is arranged to produce a minimum of resistance. As soon as the person opening the door has relinquished his grip of the door panel 3, the return motion (see FIG. 2) of the piston unit 8 starts under bias of the pressure spring 10, this motion being transmitted via the rack part 13 and the gear 12 via the arm mechanism 2, which thereby produces a pivoting of the door panel in the closing direction. An over pressure is then created in the portion 15 of the cylinder space, and consequently dampening medium via the by-pass channel 18 is forced into the chamber 16 of the cylinder space on the other side of the sealing portion 14 of the piston unit 8, while the non return check valve 23 at the same time prevents flow through the channel 17. In the by-pass channel 18 the check or throttle valve 22 is adjusted to such extent that a comparatively slow closing motion is obtained for the door panel over an angular interval, which is determined by the position of the orifice 24 in the third by-pass channel 19. When the piston unit 8 has passed the orifice 24, so that its sealing portion 14 is located with the orifices 20 and 24 on each side thereof, the speed of motion of the piston is increased. This is due to the dampening medium being able to flow also through the channel 19, so that the total by-pass flow from the portion 15 to the portion 16 of the cylinder space is increased to a degree, which is determined by the position of the check valve or throttle 25 and the dimensioning of the channel 19, which brings means that the closing motion of the door reaches a greater speed over an angular interval as the door approaches the closed position.

Thus by pivoting the door panel into different opening positions, when the door is opened, one can obtain different periods of closing time for the door according to need. If by way of example one desires to pass through the door with luggage, a bicycle or similar, the door is suitably pivoted to a maximum of opening angle, whereby the longest period of closing time is obtained, while in connection with normal passage one only pivots the door to an angle sufficient to permit the passage, whereby the door is relatively rapidly closed again.

The non-return valve in the fourth by-pass channel 29 is as shown herein above, arranged to bring the two space portions 15, 16 in communication with each other only if the pressure in the chamber 15 exceeds the pressure in the chamber 16 by a predetermined pressure controlled by a valve designed for such pressure, whereupon the dampening medium is brought to flow from the chamber 15 to the chamber 16. It is thus hereby possible for a person to close the door rapidly like a conventional door without a door-closer, while avoiding subjecting the mechanism to exceptional stresses.

The very good closing capacity and the long period of the closing operation according to the invention are achieved by a reduction to a minimum of the power losses due to leakage past the piston, and this minimum can be maintained also in connection with very great spring forces and consequently high hydraulic pressures. By the good seal provided against leakage also in connection with high hydraulic pressures a great spring force can be chosen, by which arrangement a great closing force is obtained at the same time as the door can be given a very slow closing motion over a predetermined angular span. It has previously not been possible to solve this problem with any door-closer and to retain these characteristics after several years of use, and this is an essential part of the problem solved by the invention. It is also an essential point that the good seal implies that the speed of the closing operation can be varied with a very good precision, which previously has constituted a great problem. By the sealing ring according to the invention exhibiting very good resistance against wear, the good performance of the door-closer is maintained for years with a minimum of need for service.

The invention is not limited to the embodiment described above and illustrated in the drawings by way of example only. For example the check valves can be designed in a different manner, by omitting the tapering portions illustrated in FIG. 2, the three by-pass channels by way of example can be completely separated in between them and thereby communicate with separate orifices in the cylinder walls. Moreover it should be pointed out that the views illustrated are schematic and lack certain construction details, as plugs in the piston/-cylinder assembly to stop up certain bores, which have been necessary to make for the machining of certain channels.

I claim:

1. A door closing device comprising a fluid filled cylinder, a piston within said cylinder forming a first and second chambers and slidable in opposite directions, an arm and gear mechanism connected to the piston and adapted to be further connected to a pivotable door in order to transmit opening and closing movements of the door to the piston and vice versa, a sealing ring of metallic material positioned in a groove at one end of said piston, said sealing ring being open and expandable against the wall of said cylinder, a spring forcibly biasing the piston in one of its slidable directions, first and second by-pass channels communicating through a first port with a first chamber formed by one extreme end of said piston and through a second port with the second chamber formed by said piston, said first by-pass channel being provided with a check valve arranged to permit the free-flow of fluid in a direction caused by the piston sliding against the bias of the spring and to check the flow of fluid in the opposite direction, said second by-pass channel being provided with a throttle valve arranged to retard the flow of fluid in both directions, a third by-pass channel communicating said first port and said first chamber with a third port positioned between said first and second ports and at a distance with respect to the distance travelled by the sealing ring to permit intermittent communication of said third port with said first chamber.

2. A door closing device according to claim 1 wherein the third by-pass channel is provided with an adjustable throttle valve.

3. A door closing device according to claim 2 wherein a fourth by-pass channel is provided in the piston head and a check valve responsive to predetermined excessive pressure is mounted therein.

* * * * *